US009589743B2

(12) United States Patent
Lu et al.

(10) Patent No.: US 9,589,743 B2
(45) Date of Patent: Mar. 7, 2017

(54) MINITYPE BREAKER WITH HIGH STABILITY

(71) Applicant: NOARK ELECTRICS (SHANGHAI) CO., LTD., Shanghai (CN)

(72) Inventors: Qian Lu, Shanghai (CN); Pengbin Yan, Shanghai (CN)

(73) Assignee: NOARK ELECTRICS (SHANGHAI) CO., LTD. (CN)

( * ) Notice: Subject to any disclaimer, the term of this patent is extended or adjusted under 35 U.S.C. 154(b) by 83 days.

(21) Appl. No.: 14/429,703

(22) PCT Filed: Mar. 26, 2013

(86) PCT No.: PCT/CN2013/073185

§ 371 (c)(1),
(2) Date: Mar. 19, 2015

(87) PCT Pub. No.: WO2014/044036

PCT Pub. Date: Mar. 27, 2014

(65) Prior Publication Data

US 2015/0255228 A1 Sep. 10, 2015

(30) Foreign Application Priority Data

Sep. 20, 2012 (CN) ..... 2012 2 0483804 U

(51) Int. Cl.
*H01H 3/20* (2006.01)
*H01H 3/06* (2006.01)
(Continued)

(52) U.S. Cl.
CPC ..... *H01H 3/20* (2013.01); *H01H 3/06* (2013.01); *H01H 3/38* (2013.01); *H01H 3/46* (2013.01);
(Continued)

(58) Field of Classification Search
CPC .. H01H 3/20; H01H 3/38; H01H 3/46; H01H 3/06; H01H 9/34; H01H 9/32; H01H 71/526; H01H 73/18
(Continued)

(56) References Cited

U.S. PATENT DOCUMENTS 4,001,743 A * 1/1977 Arnhold ..... H01H 73/18 335/201
5,164,693 A * 11/1992 Yokoyama ..... H01H 9/46 335/14
(Continued)

FOREIGN PATENT DOCUMENTS

CN 1664971 A 9/2005
CN 201210469 3/2009
(Continued)

OTHER PUBLICATIONS

International Search Re port dated Jul. 4, 2013 issued in corresponding International patent application No. PCT/CN2013/073185.

*Primary Examiner* — Renee Luebke
*Assistant Examiner* — William Bolton
(74) *Attorney, Agent, or Firm* — Ostrolenk Faber LLP

(57) ABSTRACT

A high-stability miniature circuit breaker has a pivotal shaft having a first section, a second section and a shoulder. The diameter of the second section is larger than the first section. The shoulder diameter is larger than the second section. A pivoting lever on the first section limits the axial position of a protruding mesa relative to the shaft by contact fit between the mesa and a thrust surface on the second section. A pivoting latch is on the second section. A first end face fits to a support surface on the shoulder. A second end face fits to the protruding mesa at the other end. The latch controls a drive rod and the lever. A connecting rod separates from the
(Continued)

latch when latch hasps are separated and the latch separates from the drive rod which slides along a groove of the lever.

10 Claims, 5 Drawing Sheets

(51) Int. Cl.

| | |
|---|---|
| ***H01H 3/38*** | (2006.01) |
| ***H01H 3/46*** | (2006.01) |
| ***H01H 9/34*** | (2006.01) |
| ***H01H 71/02*** | (2006.01) |
| ***H01H 73/18*** | (2006.01) |
| ***H01H 71/52*** | (2006.01) |

(52) U.S. Cl.
CPC ..... *H01H 71/526* (2013.01); *H01H 9/34* (2013.01); *H01H 71/0207* (2013.01); *H01H 73/18* (2013.01); *H01H 2221/036* (2013.01)

(58) Field of Classification Search
USPC ..... 218/149, 140, 1, 7; 335/201
See application file for complete search history.

(56) References Cited

U.S. PATENT DOCUMENTS

| | | | | |
|---|---|---|---|---|
| 6,346,868 | B1 | 2/2002 | Castonguay et al. | |
| 6,667,680 | B1 * | 12/2003 | Gibson | H01H 71/501 336/172 |
| 6,717,090 | B2 * | 4/2004 | Kling | H01H 9/302 218/151 |
| 2007/0034495 | A1 * | 2/2007 | Christmann | H01H 71/526 200/400 |
| 2012/0152903 | A1 * | 6/2012 | Vigouroux | H01H 71/526 218/117 |

FOREIGN PATENT DOCUMENTS

| | | |
|---|---|---|
| CN | 102426998 | 4/2012 |
| CN | 202196726 U | 4/2012 |
| CN | 102436983 | 5/2012 |
| CN | 102867705 | 1/2013 |
| CN | 202816829 | 3/2013 |

* cited by examiner

MINITYPE BREAKER WITH HIGH STABILITY

CROSS REFERENCE TO RELATED APPLICATIONS

The present application is a 35 U.S.C. §371 National Phase conversion of PCT/CN2013/073185, filed Mar. 26, 2013, which claims benefit of Chinese Application No. 201220483804.8, filed Sep. 20, 2012, the disclosure of which is incorporated herein by reference. The PCT International Application was published in the Chinese language.

TECHNICAL FIELD OF THE INVENTION

The present invention relates to a low voltage circuit breaker in the field of power distribution, and in particular, to a high-stability miniature circuit breaker which includes a latch assembly for stabilizing the action performances of the miniature circuit breaker and an arc extinguish chamber fitted with the latch assembly.

BACKGROUND OF THE INVENTION

An existing miniature circuit breaker (hereinafter referred to as circuit breaker), serving as a line protection element, has been widely used. Its number of mass production is bigger and bigger and its application fields are wider and wider. As a result, a higher demand on the stability of the working performance of the circuit breaker is raised. From the most basic working requirement of the circuit breaker, the working performance of the circuit breaker includes acting characteristic, operating characteristic and breaking characteristic. However, the basis to measure the stability of the circuit breaker is mainly associated with the time; for example, the acting characteristic of the circuit break is mainly represented on time stability of the time-delay characteristic, long duration of the operating characteristic, and short breaking time. The acting characteristic of the circuit breaker needs to be realized by virtue of a release in an operating mechanism. When trigging one acting characteristic of the circuit breaker, a latch assembly in the last link of the operating mechanism needs to be pushed finally to unlock the mechanism no matter how many links are transferred in the process. It follows that the stability of the acting time of the latch assembly in the operating mechanism of the circuit breaker plays a decisive role in the time stability of the acting characteristic. The long-term actionable characteristic of the circuit breaker also needs to be realized by the reliable fit between a connecting rod and the latch assembly in the operating mechanism. The breaking characteristic of the circuit breaker is to further shorten the breaking time by virtue of an arc extinguish chamber in the circuit breaker except for being related to the acting time of the latch assembly in the operating mechanism. It is apparent that the acting characteristic, the operating characteristic and the breaking characteristic of the circuit breaker are closely related to the stability of the acting time of the latch assembly.

The prior art starts from improving the stability of the acting time of the latch assembly, which is mainly realized through controlling the tripping force of the latch assembly. Since the tripping force is related to a contact pressure produced by the meshing between the connecting rod and the latch assembly in the operating mechanism, the tripping force needs to be controlled and decreased in order to ensure said stability of the acting time of the latch assembly. At present, there are two schemes that are commonly used to control and decrease the tripping force: one scheme is to control the tolerance of the force or torque produced by various springs in the operating mechanism, i.e., to ensure the consistency of the contact pressure produced from the fit between the connecting rod and the latch assembly in the operating mechanism through a spring processing technology; and the other scheme is to decrease the tripping force by regulating a force bearing arm to propel the latch assembly as well as regulating a moment arm of the contact pressure produced by the fit between the connecting rod and the latch assembly in the operating mechanism. However, it is failed to achieve satisfactory results of improving the stability of the working performance of the circuit breaker from the aspect of obtaining a stable tripping force by either using the first or second scheme or jointly using the two existing schemes. The actual application process shows that: since the stability of the acting time of the latch assembly is mainly realized by the size of the tripping force, there will still be inconsistent changes in the tripping force of the same mechanism in each time. The tripping force is fluctuated in disorder when continuously closing after releasing the operating mechanism; and becomes stronger in a constant value when closing and intermittently releasing the operating mechanism. The phenomenon of the tripping force that becomes stronger is in contradiction with the object to improve the stability of the operating characteristic of the circuit breaker, and therefore, the stability of the circuit breaker products produced after the adoption of these existing schemes still cannot meet the specific requirements of the market.

In addition, the stability of the breaking performance of the existing circuit breaker is further express by increasing the arc extinguish ability of the arc extinguish chamber on the basis of ensuring the stability of the acting time of the latch assembly in an auxiliary way. The existing arc extinguish measures in this aspect mainly include: to add a concentrating flux plate in an arc channel to perform magnetic blow-out to elongate the arc; to perform air-blowing on the materials of the arc channel by adding gassing materials at the same time, so as to improve the gas dielectric strength of the arc space; to increase the number of arc extinguish gate sheets to raise the arc voltage; and to improve the exhaust condition at the end of the arc extinguish chamber and control the time of the arc within the arc extinguish gate sheet to limit arcing. All these existing measures have correspondingly increased the breaking ability of the circuit breaker, but have unsatisfactory effects on improving the stability of the breaking characteristic of the circuit breaker; for example, the structure gap between the arc extinguish gate sheets may be broken due to oversize breaking air flow in the breaking process, resulting in the loss of arc extinguish ability or unstable arc extinguish ability of the arc extinguish chamber, and even presenting opposite results between next breaking characteristic and previous breaking characteristic of the circuit breaker to reduce the breaking operation consistency.

SUMMARY OF THE INVENTION

The object of the present invention is to provide a high-stability miniature circuit breaker which overcomes all defects of the foregoing prior arts, and solves the problem of poor stability of the circuit breaker caused by the change of a tripping force of an operating mechanism through a scheme that a lever and a latch assembly are installed coaxially and the latch assembly can swing properly along the axial direction of a pivotal shaft while rotating around the pivotal shaft; and solves the problem of poor stability of the circuit breaker caused by the change of an impact force of a release through a scheme that a wedge-shaped linking pin is added to improve a connecting structure of the lever and the latch assembly. Thereby, the problem of poor stability of the circuit breaker caused by the damage of the arc extinguish chamber by said breaking air flow is solved through a scheme that insulation baffle ribs are added to improve the structure of the arc extinguish chamber. Furthermore, the problem of poor stability of the circuit breaker caused by the change of an elastic force of a return spring is solved through a scheme that the structure of the return spring is improved. The high-stability miniature circuit breaker according to the present invention not only takes measures to solve the problem of poor stability of the circuit breaker in a packaged manner from a plurality of aspects with respect to different inducements, but also has the features of simple structure and good operability Another object of the present invention is to be capable of stretching arc and cooling arc again through a head structure of the insulation baffle ribs and capable of intensifying and increasing the arc voltage value of the arc extinguish chamber while strengthening the front end intensity of the arc extinguish chamber.

To realize the foregoing objects, the present invention employs a specific technical scheme as follows.

A high-stability miniature circuit breaker includes a release 2, an operating mechanism 3, an arc extinguish chamber 4 and a contact assembly 5. The operating mechanism 3 includes a handle 33 installed on a handle shaft 10 of a shell 1 in a pivoting way, a drive rod 34, a lever 36, a connecting rod 37 installed on a pivotal shaft 360 of the lever 36 in a pivoting way, a latch assembly 39, a return spring 32 and an energy storage spring. One end of the energy storage spring is connected to the shell 1 of the circuit breaker, and the other end of the energy storage spring is connected to the lever 36. One end of the drive rod 34 is hinged connected to the handle 33, the other end of the drive rod 34 is connected to the lever 36, and that end of the drive rod 34 connected with the lever 36 is also fitted with a control end 370 of the connecting rod 37 and controlled by the control end 370. The contact assembly 5 is connected to the lever 36 through a contact support 51. The operating mechanism 3 further includes a pivotal shaft 38 fixed on the shell 1, which includes a first shaft section 381, a second shaft section 382 and a shaft shoulder 383. The diameter of the second shaft section 382 is larger than that of the first shaft section 381, and a thrust surface 3821 is formed on the second shaft section 382 at the combined portion of the two shaft sections. The diameter of the shaft shoulder 383 is larger than that of the second shaft section 382, and a support surface 3831 is formed on the shaft shoulder 383 at the combined portion of the second shaft section and the shaft shoulder. The lever 36 is installed on the first shaft section 381 of said pivotal shaft 38 through a first shaft hole 361 in a pivoting way, and is used for limiting the axial position of a protruding mesa 362 relative to the pivotal shaft 38 through contact fit between the protruding mesa 362 disposed on the lever 36 and the thrust surface 3821 on the pivotal shaft 38. The latch assembly 39 is installed on the second shaft section 382 of the pivotal shaft 38 through a second shaft hole 393 in a pivoting way. One end of the second shaft hole 393 includes a first end face 391 fitted with the support surface 3831 of said pivotal shaft 38. The other end of the second shaft hole 393 includes a second end face 392 fitted with the protruding mesa 362 of the lever 36. The latch assembly 39 is also provided with a second hasp 394. A first hasp 371 fitted with the second hasp 394 of the latch assembly 39 is disposed on said connecting rod 37. The connecting rod 37 is meshed with the latch assembly 39 when the first hasp 371 and the second hasp 394 are contacted and locked with each other, and the latch assembly 39 controls the drive rod 34 and the lever 36 not to move relatively. The connecting rod 37 is separated from the latch assembly 39 when the first hasp 371 and the second hasp 394 are separated and unlatched, and the latch assembly 39 is separated from the drive rod 34 to lead the drive rod 34 to be capable of sliding along a groove 364 in the lever 36.

Further, the diameter D of the second shaft hole 393 of the latch assembly 39 is larger than the diameter d of the second shaft section 382 of said pivotal shaft 38, and the difference Dc of the two diameters is obtained by subtracting the diameter d from the diameter D. The spacing H between the support surface 3831 on the shaft shoulder 383 of said pivotal shaft 38 and the protruding mesa 362 on the lever 36 is larger than the spacing h between the first end face 391 and the second end face 392 of said latch assembly 39, and the spacing difference Hc is obtained by subtracting the spacing h from the spacing H. The diameter difference Dc and the spacing difference Hc together control the directional deflection swing of the latch assembly 39, and the deflection swing direction is the direction X of the contact pressure generated when the latch assembly is meshed with the connecting rod 37.

Further, the spacing difference Hc is preferably 5% to 10% of the diameter d of the second shaft section 382 of said pivotal shaft 38, and a corresponding fit value is evaluated for the diameter difference Dc according to the spacing difference Hc, the diameter d and length L of the second shaft section 382 of said pivotal shaft 38. Or, said diameter difference Dc is preferably 5% to 10% of the length L of the second shaft section 382 of said pivotal shaft 38, and a corresponding fit value is evaluated for the spacing difference Hc according to the diameter difference Dc, the diameter d and length L of the second shaft section 382 of said pivotal shaft 38.

Further, the lever 36 is also provided with a wedge-shaped linking pin 363 thereon comprising a inclined plane 3631 distributed in a wedge-shape along the axial direction of said pivotal shaft 38. The latch assembly 39 is also provided with a raised surface 394. The raised surface 394 is not contacted with the wedge-shaped inclined plane 3631 when the connecting rod 37 is meshed with the latch assembly 39. When the release 2 triggers the latch assembly 39, the releasing impact force of the release 2 drives said raised surface 394 to be contacted with the wedge-shaped inclined plane 3631 to prevent and eliminate unfavorable and abnormal deflection swings generated by the latch assembly 39.

Further, the arc extinguish chamber 4 includes two separately and relatively disposed insulated gate boards 43 and a plurality of arc extinguish gate sheets 44 respectively cliped and fixed between the two separate insulated gate boards 43 by equal gate sheet spacing m. The arc extinguish chamber 4 further includes two insulated baffle ribs 42. Each insulated baffle rib 42 is a rack-shaped structure formed by an insulated board body 422 and gears 421 above the insulated board body 422. The insulated board bodies 422 of the two insulated baffle ribs 42 are respectively overlapped and fixed at the front ends of the two separate insulated gate boards 43. The width t of the gear top of each gear 421 is smaller than the width T of the gear root of each gear. The width T of the gear root is equal to the gate sheet spacing m between the two arc extinguish gate sheets 44. The root portion of each gear 421 is correspondingly embedded and fixed in each gate sheet spacing m of the arc extinguish gate sheet 44, and each arc extinguish gate sheet 44 is embedded and fixed in the gear root spacing M of each gear 421. The gear root spacing M between two adjacent gear roots is equal to the thickness S of the arc extinguish gate sheet 44. Further, the width t of the gear top of said gear 421 on the insulated board body 422 does not exceed 50% of the width T of the gear root.

Further, the return spring 32 is a soft spring having a very small elasticity change rate. One end 321 of the return spring 32 is connected to the lever 36, and the other end 322 of the return spring is connected to the latch assembly 39. The parameters of the return spring 32 are preferred as: the wire diameter of the spring is equal to or small than 0.3 mm, and the number of turns of the spring is at least 10.

Further, the free end of the first shaft section 381 of said pivotal shaft 38 includes a first end tip 3811. The shaft shoulder 383 of said pivotal shaft 38 further includes a second end tip 3832 relative to the direction opposite to said first end tip 3811. The first end tip 3811 and the second end tip 3832 are respectively fixedly connected to the shell 1. Or, the pivotal shaft 38 includes the first end tip 3811 fixedly connected to the shell 1. Or, the pivotal shaft 38 includes the second end tip 3832 fixedly connected to the shell 1.

Further, the axial position of the protruding mesa 362 for defining the lever 36 relative to the pivotal shaft 38 is driven by the acting force of the shell 1 on the lever 36 so that the contact fit between the protruding mesa 362 and the thrust surface 3821 on the pivotal shaft 38 is realized; or, driven by the acting force of a transition piece on the lever 36 so that the contact fit between the protruding mesa 362 and the thrust surface 3821 on the pivotal shaft 38 is realized.

Further, the shaft centers of the first shaft section 381, the second shaft section 382 and the shaft shoulder 383 of said pivotal shaft 38 are all concentric. Or, one of the shaft centers of the first shaft section 381, the second shaft section 382 and the shaft shoulder 383 is not concentric with the other two shaft centers. Or, the three shaft centers of the first shaft section 381, the second shaft section 382 and the shaft shoulder 383 are not concentric with each other.

It is found by the applicant upon constantly studying and improving the foregoing schemes of the prior arts that the tripping force is fluctuated in disorder when continuously closing and releasing the operating mechanism; and the tripping force becomes stronger when closing and intermittently releasing the operating mechanism. These problems are caused by that the present design only considers the influence of the contact pressure produced by the meshing between the connecting rod and the latch assembly in the operating mechanism on the tripping force, but does not consider the influence of the frictional force produced by contacting between the latch assembly and each element in the operating mechanism, which is just the problem to be solved by the present invention. It is found that the frictional force produced by contacting between the latch assembly and each element in the operating mechanism is the major cause for the stronger and fluctuate of the tripping force. The applicant after comprehensively analyzing the influence of the frictional force starts from the structure improvement of the operating mechanism and the latch assembly, and controls the influence of the frictional force on the operating mechanism within an allowable range, thus overcoming the defect of disorder fluctuation caused by a stronger constant value of the tripping force and the influence of the frictional force on the tripping force. Meanwhile, in order to further improve the breaking stability, and with respect to the loss of the arc extinguish ability or the unstable arc extinguish ability of the circuit breaker due to the destroy of the structure gap of the arc extinguish gate sheets, the present invention increases the intensity of the arc extinguish gate sheets and enables the arc extinguish gate sheets to maintain the due structure gap within the breaking ability range of the circuit breaker. The device of the present invention effectively increases stability of the acting characteristic, operating characteristic and breaking characteristic while improving the acting characteristic, operating characteristic and breaking characteristic of the circuit breaker product through the improvement on relevant structures of the above mentioned operating mechanism, latch assembly and arc extinguish gate sheets.

DETAILED DESCRIPTION OF THE PREFERRED EMBODIMENTS

Figure 1:
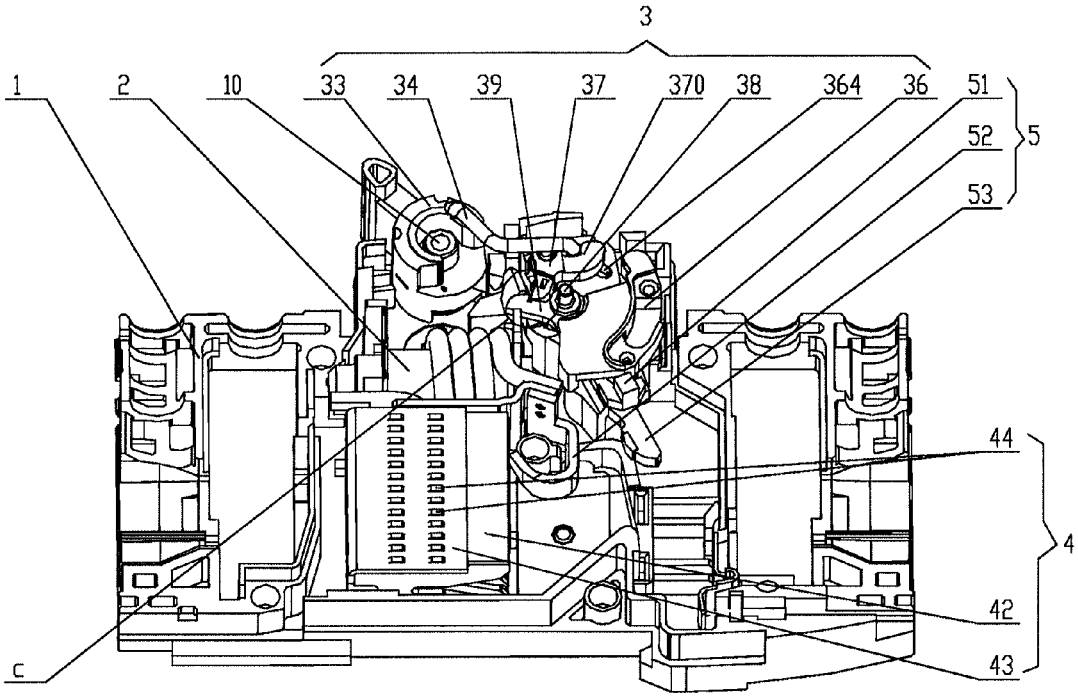
FIG. 1 is a schematic perspective view of a structure of a high-stability miniature circuit breaker according to embodiments of the present invention.

It is found by the applicant upon constantly studying and improving these foregoing existing technical solutions that: the stability of the tripping force is related with the size of the tripping force, but is mainly and closely related to the frictional force of the mechanism and the stability of a force acting on acting on the latch assembly; therefore, starting from improving the frictional force and the stability of the force acting on the latch assembly to improve the structural design has more effective effects for obtaining a stable tripping force. More specifically, the stability of the tripping force except being influenced by the contact pressure produced by the meshing between the connecting rod and the latch assembly in the operating mechanism, is further influenced by the frictional force produced by the contacting between the latch assembly and each element in the operating mechanism. The static friction force is produced by that the direction of the contact pressure produced by the meshing between the latch assembly and the connecting rod of the operating mechanism is not vertical to the axial direction of the rotating shaft of the operating mechanism, and the latch assembly and the locating surface may occurs to contacting of the installation face due to installation limitation and surface contact occurs to the latch assembly and the rotating shaft due to acting limitation, so that the latch assembly is not as envisaged in the design concept, namely, not prevented from the influence of static frictional force of installation on the same plane and does not keep point or line contact with the rotating shaft. Therefore, based on the foregoing analysis, when intermittently operating the operating mechanism, the existing mechanism is in a stable state due to long term closing, and each element in the operating mechanism trends to be stable due to the contact pressure produced by the springs and a stable static frictional force is produced; and then, when releasing the operating mechanism, the tripping force except overcoming the contact pressure produced by the meshing between the latch assembly and the connecting rod of the operating mechanism, also needs to overcome the static frictional force between each element of the mechanism; therefore, when a stronger tripping force appears, the stronger value is also relatively constant, thus directly destroying the stability of the latch assembly. When continuously operating the mechanism, since the closing time of the mechanism is short and the static frictional force between each element in the operating mechanism is unstable and fluctuates, even if releasing the same mechanism, it still needs to overcome the contact pressure produced by the meshing between the latch assembly and the connecting rod in the operating mechanism as well as the static frictional force fluctuated between each element of the mechanism, thus causing disorder fluctuation of the tripping force. The implementations of the present invention for solving the multiple problems of the foregoing prior arts are specifically illustrated with reference to the embodiments given in drawings 1 to 10. The high-stability miniature circuit breaker according to the present invention is not limited to the descriptions in the embodiments with reference to the drawings hereinafter.

Figure 2:
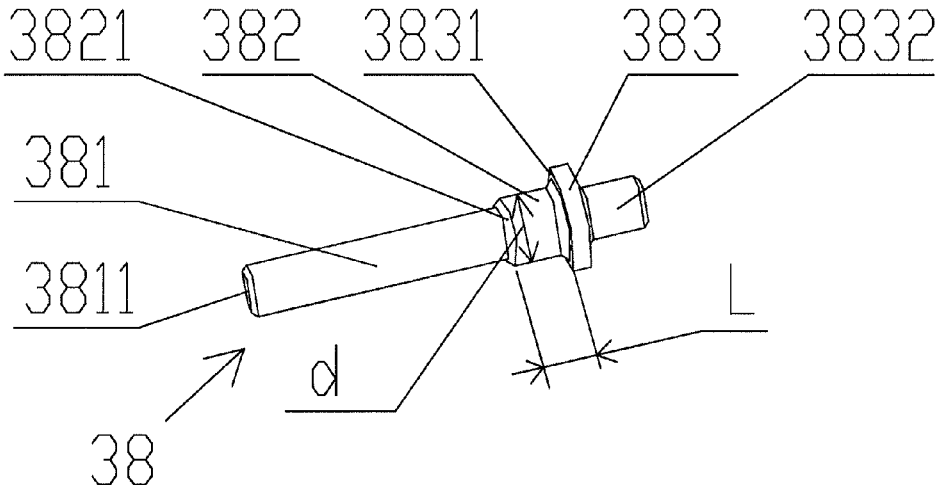
FIG. 2 is a schematic perspective view of components structure of one implementation scheme of a pivotal shaft 38 of an operating mechanism 3 as shown in FIG. 1.
Figure 3:
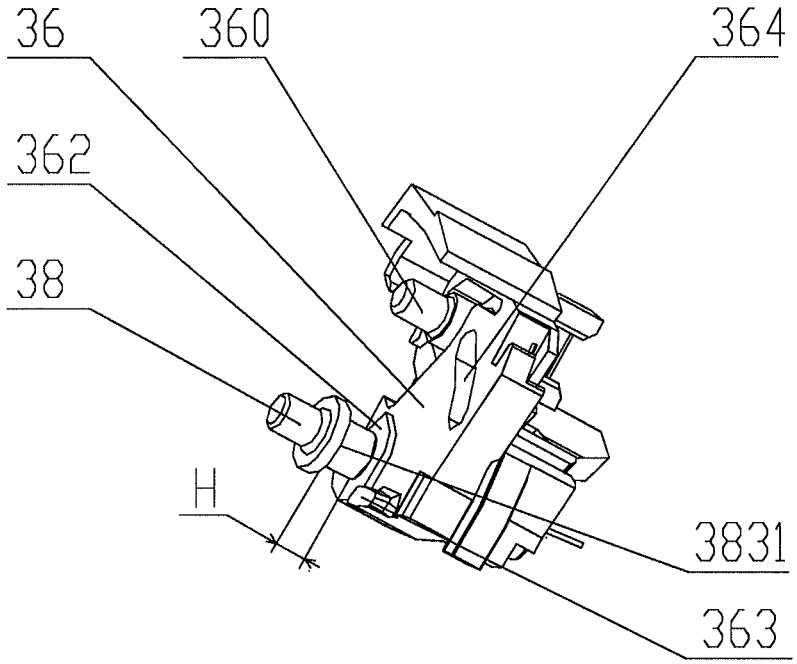
FIG. 3 is a schematic perspective view of assembling a lever 36 and the pivotal shaft 38 of the operating mechanism 3 as shown in FIG. 1.
Figure 4:
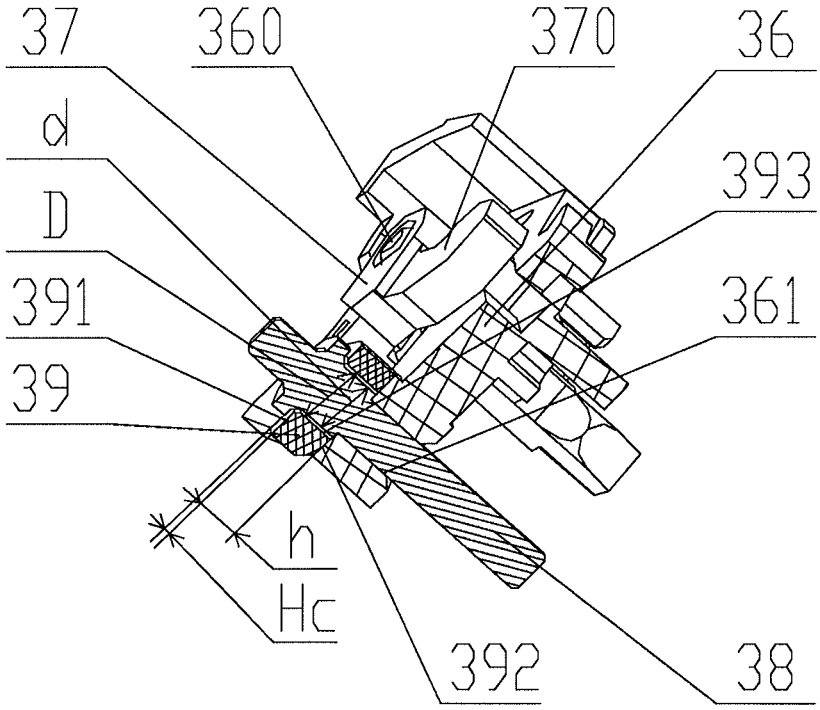
FIG. 4 is a schematic perspective view of assembling the lever 36, a connecting rod 37, a latch assembly 39 and the pivotal shaft 38 of the operating mechanism 3 as shown in FIG. 1, wherein the latch assembly 39 in the figure is under a non-deflection swing state.
Figure 5:
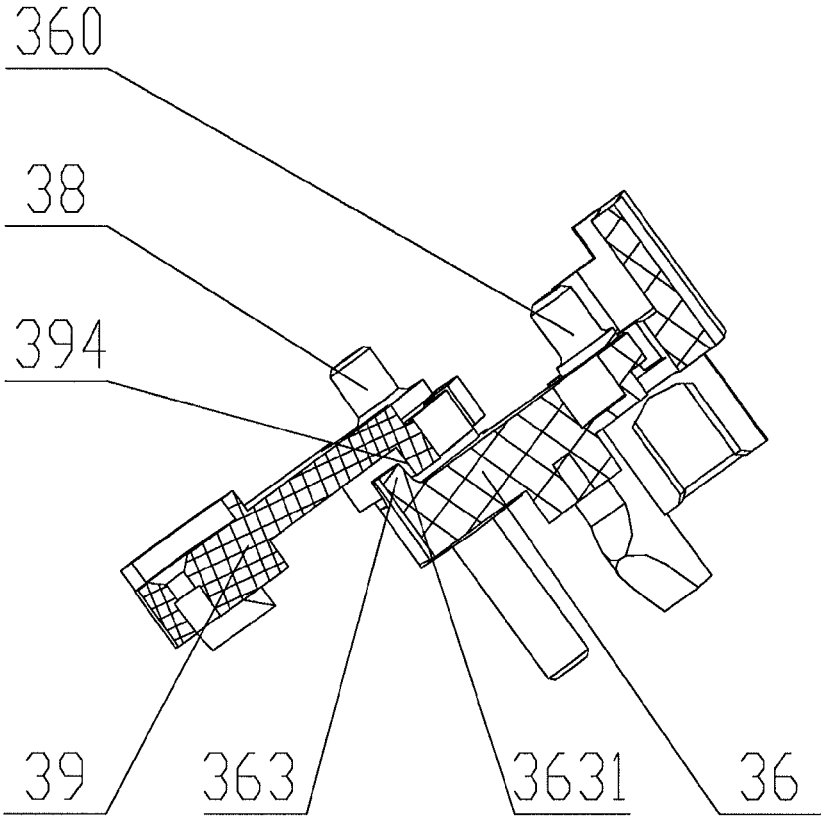
FIG. 5 is a partial enlarged drawing of a plane assembly perspective view of the lever 36, the connecting rod 37, the latch assembly 39 and the pivotal shaft 38 of the operating mechanism 3 as shown in FIG. 1, wherein the latch assembly 39 in the figure is under a deflection swing state.
Figure 6:
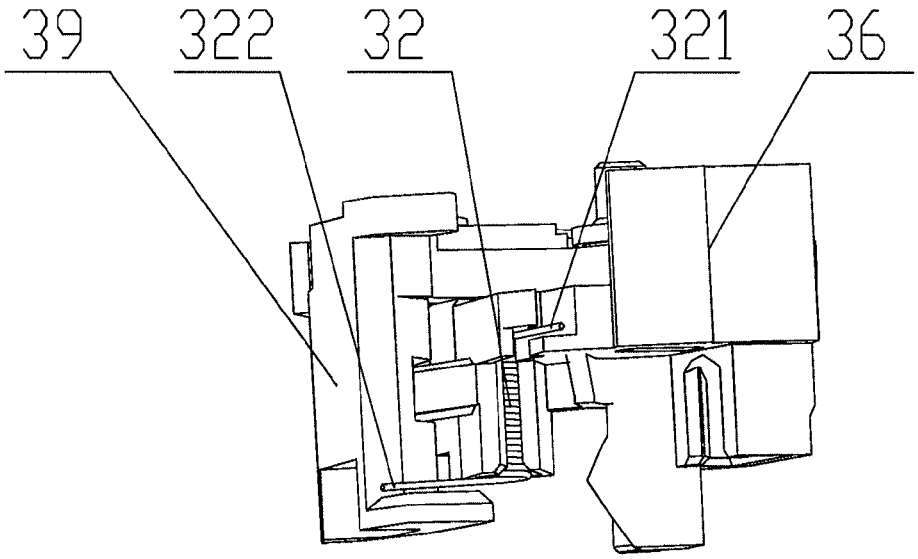
FIG. 6 is a schematic perspective view of assembling the lever 36, the latch assembly 39 and the pivotal shaft 38 of the operating mechanism 3 as shown in FIG. 1.
Figure 7:
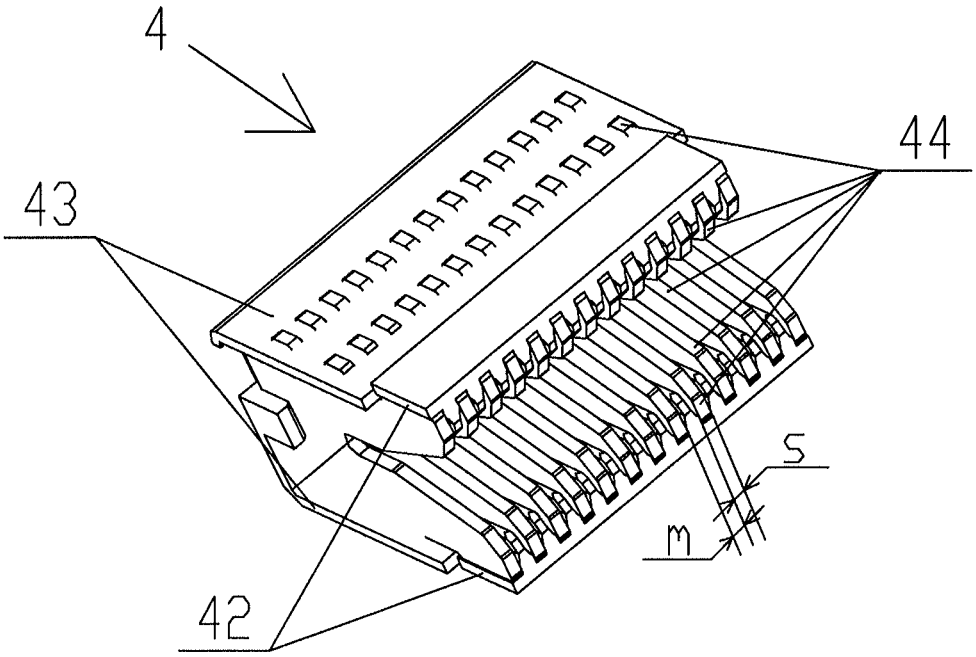
FIG. 7 is a schematic perspective view of assembling the lever 36, the latch assembly 39 and a return spring 32 of the operating mechanism 3 as shown in FIG. 1.
Figure 8:
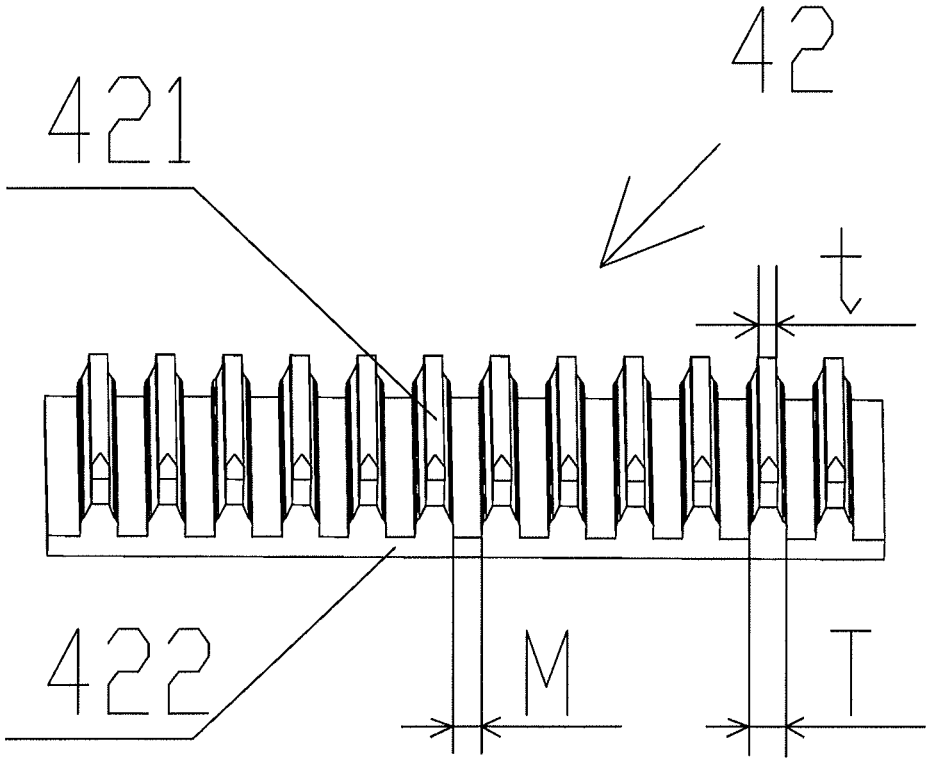
FIG. 8 is a schematic perspective view of an arc extinguish chamber 4 of the high-stability miniature circuit breaker according to embodiments of the present invention as shown in FIG. 1.
Figure 9:
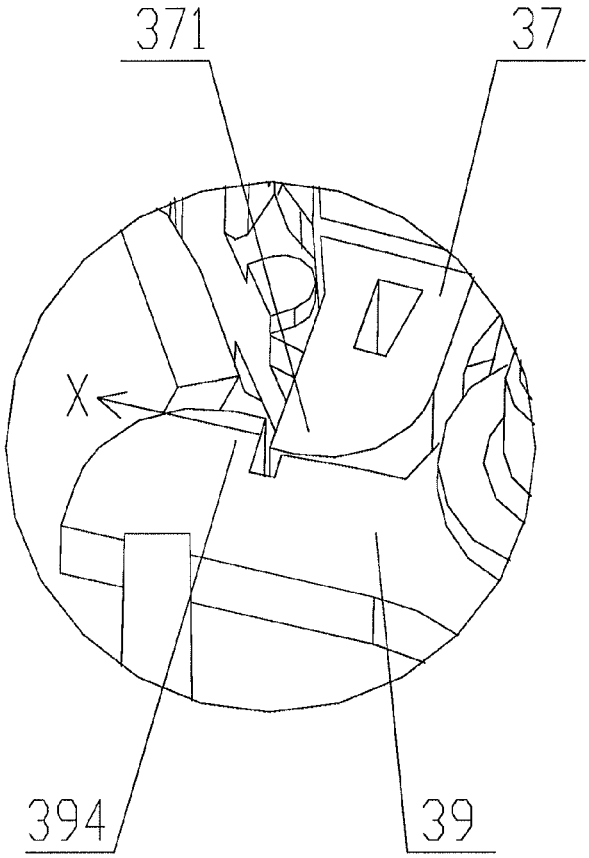
FIG. 9 is a schematic perspective view of components structure of an insulated baffle rib 42 of the arc extinguish chamber 4 as shown in FIG. 7.
Figure 10:
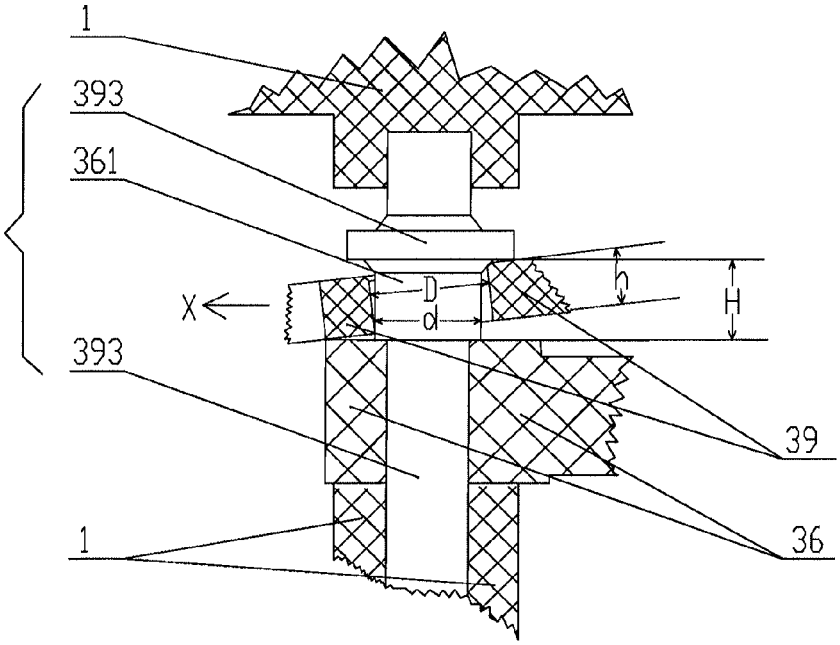
FIG. 10 is a partial enlarged drawing of C of FIG. 1.

In FIGS. 1-10, FIG. 1 is a schematic perspective view of a high-stability miniature circuit breaker according to embodiments of the present invention. The figure shows structures of partial parts such as a shell 1, a release 2, an operating mechanism 3, an arc extinguish chamber 4 and the like of the circuit breaker. The figure also shows structures of partial parts such as a return spring 32, a handle 33, a drive rod 34, a contact support 35, a lever 36, a connecting rod 37, a pivotal shaft 38, a latch assembly 39 and the like in the operating mechanism 3 and related to the present invention. FIGS. 2-7 and FIG. 10 are embodiments of the operating mechanism 3 as shown in FIG. 1, wherein FIG. 2 is a stereoscopic structure block diagram of a spare part of a pivotal shaft 38 in FIG. 2, FIG. 3 shows structures of a lever 36 and the pivotal shaft 38 as well as an assembly relationship between the lever 36 and the pivotal shaft 38, FIG. 4 shows structures of the lever 36, a connecting rod 37, a latch assembly 39 and the pivotal shaft 38 as well as an assembly relationship between the lever 36, the connecting rod 37, the latch assembly 39 and the pivotal shaft 38, wherein the latch assembly 39 in the figure is under a non-deflection swing state, A partial enlarged drawing of a plane assembly block diagram of FIG. 5 shows structures of the lever 36, the connecting rod 37, the latch assembly 39 and the pivotal shaft 38 as well as an assembly relationship thereof, wherein the latch assembly 39 in the figure is under a deflection swing state, FIG. 6 shows an assembly relationship between a linking pin 363 of the lever 36 and a raised surface 395 of the latch assembly 39 as well as a of a inclined plane 3631 distributed in a wedge-shape along the axial direction of the pivotal shaft 38 and a structure of the raised surface 395 of the latch assembly 39, and FIG. 7 shows a structure of a return spring 32 and an assembly relationship between the lever 36, the latch assembly 39 and the return spring 32. FIG. 10 is a partial enlarged drawing of C of FIG. 1, showing structures of a first hasp 371 of the connecting rod 37 and a second hasp 394 of the latch assembly 39 as well as an assembly relationship there between.

The high-stability miniature circuit breaker according to the present invention includes a release 2, an operating mechanism 3, an arc extinguish chamber 4 and a contact assembly 5. A mobile contact 53 of said contact assembly 5 is connected to a contact support 51. The mobile contact 53 moves with the movement of a lever 36 through the connection between the mobile contact 53 and the contact support 51 and the connection between the contact support 51 and the lever 36, and the mobile contact 53 is closed/disconnected with the corresponding static contact 52 under the control of the lever 36. Except the known parts of the foregoing structures, the circuit breaker according to the present invention further includes other parts that are usually included in a conventional miniature circuit breaker, such as a linkage and a junction device and the like. Since these parts are not peculiar contents of the present invention, descriptions or definition on the structures thereof are omitted. The operating mechanism 3 includes a handle 33 installed on a handle shaft 10 of a shell 1 in a pivoting way, a drive rod 34, a lever 36, a connecting rod 37 installed on a pivotal shaft 360 of the lever 36 in a pivoting way, a latch assembly 39, a return spring 32 and an energy storage spring (not shown in the figures). The structure and connection of the energy storage spring is known, one end of the energy storage spring is connected to the shell 1 of the circuit breaker, and the other end of the energy storage spring is connected to the lever 36. The operating mechanism 3 gains a tripping force through the energy storage spring. The handle 33 is installed on the handle shaft 10 of the shell 1 in a pivoting way; therefore, the handle 33 can rotate around the handle shaft 10. The connecting rod 37 is installed on the pivotal shaft 360 of the lever 36 in a pivoting way; therefore, the connecting rod 37 can rotate around the pivotal shaft 360. One end of the drive rod 34 is hinged connected to the handle 33, therefore, the handle 33 and said end of the drive rod 34 can rotate relatively around a fulcrum of the pivot coupling, while the fulcrum of said pivot coupling deviates the handle shaft 10. One end of said drive rod 34 is hinged connected to the handle 33, the other end of the drive rod 34 is connected to the lever 36, and the end of the drive rod 34 connected to the lever 36 is also fitted with the control end 370 of the connecting rod 37 and controlled by the control end 370. The other end of the drive rod 34 is connected to the lever 36. The connected specific structure is that the other end of the drive rod 34 is inserted into a groove 364 of the lever 36. When the drive rod 34 is not controlled by the connecting rod 37, the drive rod 34 can slide in the groove 364. The end connected to the lever 36 is also fitted with the control end 370 of the connecting rod 37 and controlled by the control end 370. The so-called fit and control include two situations: one situation is that the control end 370 of the connecting rod 37 is contacted with the other end of the drive rod 34 and defines said other end of the drive rod 34 in the groove 364 of the lever 36 to make the drive rod incapable of sliding; that is, the drive rod 34 is controlled by the connecting rod 37 and cannot move relative to the lever 36. Another situation is that the control end 370 of the connecting rod 37 is separated from the other end of the drive rod 34 and said other end of the drive rod 34 can slide in the groove 364 of the lever 36; that is, the drive rod 34 is not controlled by the connecting rod 37 and can move relative to the lever 36, wherein the movement is just sliding along the groove 364 of the lever 36.

As shown in FIGS. 2-7 and FIG. 10, the operating mechanism 3 of the high-stability miniature circuit breaker according to the present invention further includes a pivotal shaft 38 fixed on the shell 1, which is a shared shaft of the lever 36 and the latch assembly 39. The pivotal shaft 38 includes a first shaft section 381, a second shaft section 382 and a shaft shoulder 383. The diameter of the second shaft section 382 is larger than that of the first shaft section 381, thus naturally forming an end surface on the second shaft section 382 at the combined portion of the two shaft sections, wherein the end surface is just a thrust surface 3821. The diameter of the shaft shoulder 383 is larger than that of the second shaft section 382, thus naturally forming an end surface on the shaft shoulder 383 at the combined portion of the second shaft section and the shaft shoulder, wherein the end surface is just a support surface 3831. The shaft centers of the first shaft section 381, the second shaft section 382 and the shaft shoulder 383 of the embodiment given in FIG. 2 are all concentric, which is a preferred scheme. Certainly, a replaceable scheme is that although the first shaft section 381, the second shaft section 382 and the shaft shoulder 383 are coaxial, the shaft centers thereof are not concentric. The concentric scheme includes two situations. One situation is that one of the shaft centers of the first shaft section 381, the second shaft section 382 and the shaft shoulder 383 is not concentric with the other two shaft centers. The other scheme is that the three shaft centers of the first shaft section 381, the second shaft section 382 and the shaft shoulder 383 are not concentric with each other. The influence of the force acting on the pivotal shaft 38 of the non-concentric scheme structure on the stability of the circuit breaker is poorer than that of the preferred scheme. The shaft shoulder 383 of the embodiment given in FIG. 2 further includes a second end tip 3832 for being fixedly connected to the shell 1, which is a preferred scheme. Certainly, a replaceable scheme is that the shaft shoulder 383 is not fixedly connected to the shell 1. Apparently, the stability of the replaceable scheme is poorer than that of the scheme given in the embodiment as shown in FIG. 2, since such a support structure of the pivotal shaft 38 also has the problem of being not beneficial for the stability of the force acting on the circuit breaker.

The lever 36 of the operating mechanism 3 provided with a first shaft hole 361 and a protruding mesa 362. The lever 36 is installed on the first shaft section 381 of said pivotal shaft 38 through the first shaft hole 361 in a pivoting way, and is used for limiting the axial position of a protruding mesa 362 relative to the pivotal shaft 38 through contact fit between the protruding mesa 362 disposed on the lever 36 and the thrust surface 3821 on the pivotal shaft 38. It can be apprehended through FIG. 3 that: the first end tip 3811 on the first shaft section 381 of the pivotal shaft 38 is fixedly connected to the shell 1; therefore, the lever 36 installed on the first shaft section 381 can certainly suffer the acting force from the shell 1 in a direct or indirect manner; that is, the acting force that drives the protruding mesa 362 of FIG. 3 to be contacted with the thrust surface 3821 of FIG. 2 is directly from the shell 1, i.e. the fixed connection between the first end tip 3811 and the shell 1 enables the shell 1 to be directly contacted with the lever 36 and rotate relatively. Meanwhile, the protruding mesa 362 on the lever 36 and the thrust surface 3821 on the pivotal shaft 38 realize contact fit and can rotate relatively, thus defining the axial position of the protruding mesa 362 on the lever 36 relative to the pivotal shaft 38, wherein the axial position is just the position of the protruding mesa 362 contacted with the thrust surface 3821. The embodiments given in FIG. 2 and FIG. 3 are preferred schemes. A replaceable scheme is that the acting force driving the protruding mesa 362 to be contacted with the thrust surface 3821 is directly from a transition piece (not shown in the figure) such as a spring, a washer and the like. The first end tip 3811 on the first shaft section 381 of the pivotal shaft 38 is fixedly connected to the shell 1 so that the shell 1 is contacted with the transition piece, and the transition piece is then contacted with the lever 36. The replaceable scheme is worse than the preferred scheme because it will influence the limiting precision for defining the axial position of the protruding mesa 362 relative to the pivotal shaft 38, wherein the limiting precision will also relate to the stability of the circuit breaker. No matter which scheme above is employed, defining the axial position of the protruding mesa 362 relative to the pivotal shaft 38 is just defining the spacing H between the support surface 3831 on the shaft shoulder 383 of the pivotal shaft 38 and the protruding mesa 362.

The summarized specific characteristics of the preferred scheme for the structures of the pivotal shaft 38 and the lever 36 as well as the connecting relationship there between include the following items, wherein: the specific characteristics of the pivotal shaft 38 fixed on the shell 1 are that the first shaft section 381 of the pivotal shaft 38 includes the first end tip 3811, and shaft shoulder 383 includes the second end tip 3832. The first end tip 3811 and the second end tip 3832 are respectively connected to and fixed the shell 1. The specific characteristics of the structure of the shaft center of the pivotal shaft 38 are that the shaft centers of the first shaft section 381, the second shaft section 382 and the shaft shoulder 383 of the pivotal shaft 38 are concentric. The specific characteristics of the source of the acting force for driving the contact fit between the protruding mesa 362 and the thrust surface 3821 are that the acting force for driving the contact fit between the protruding mesa 362 and the thrust surface 3821 on the pivotal shaft 38 is from the acting force of the shell 1 on the lever 36, i.e. the shell 1 and the lever 36 are directly contacted and can rotate relatively. There are many other schemes that can replace the preferred scheme given in the figures, wherein a scheme that is most possibly implemented is as follows. There are two schemes for the pivotal shaft 38 fixed on the shell 1. One scheme is that the pivotal shaft 38 includes the first end tip 3811, wherein the first end tip 3811 is fixedly connected to the shell 1. Another scheme is that the pivotal shaft 38 includes the second end tip 3832, wherein the second end tip 3832 is fixedly connected to the shell 1. There are two schemes for the structure of the shaft center of the pivotal shaft 38, wherein one scheme is that one of the shaft centers of the first shaft section 381, the second shaft section 382 and the shaft shoulder 383 is not concentric with the other two shaft centers; another scheme is that the three shaft centers of the first shaft section 381, the second shaft section 382 and the shaft shoulder 383 are not concentric with each other. The source of the acting force for driving the contact fit between the protruding mesa 362 and the thrust surface 3821 is that the acting force for driving the contact fit between the protruding mesa 362 and the thrust surface 3821 on the pivotal shaft 38 is from the acting force of the transition piece on the lever 36. This scheme includes two specific structure schemes, wherein one scheme is that the first end tip 3811 of the pivotal shaft 38 is fixedly connected to the shell 1, and in this case, the transition piece is respectively contacted with the shell 1 and the lever 36, and the three can rotate relatively; another scheme is that the first end tip 3811 of the pivotal shaft 38 is not fixedly connected to the shell 1, wherein in this case, the transition piece is fixed on the pivotal shaft 38, and meanwhile the transition piece and the lever 36 are contacted and can rotate relatively.

Referring to FIG. 4, the latch assembly 39 of the operating mechanism 3 is provided with a second shaft hole 393 and installed on the second shaft section 382 of the pivotal shaft 38 through said second shaft hole 393 in a pivoting way. One end of the second shaft hole 393 includes a first end face 391 fitted with the support surface 3831 of the pivotal shaft 38 (referring to FIG. 3). The other end of said second shaft hole 393 includes a second end face 392 fitted with the protruding mesa 362 of the lever 36. The fit here refers to a fit relationship, wherein the fit relationship includes a contact state and a non-contact state. Particularly speaking, the fit between the first end face 391 of the latch assembly 39 and the support surface 3831 of the pivotal shaft 38 is not that the first end face 391 is contacted with the support surface 3831 all the time; instead, sometimes the first end face is contacted with the support surface and sometimes the first end face is not contacted with the support surface. Moreover, during contact, either thorough contact or partial contact is feasible. Similarly, the fit between the second end face 392 of the latch assembly 39 and the protruding mesa 362 of the lever 36 is not that the second end face 392 is contacted with the protruding mesa 362 all the time; instead, sometimes the second end face is contacted with the protruding mesa and sometimes the second end face is not contacted with the support surface. Moreover, during contact, either thorough contact or partial contact is feasible. Further, the fit described herein is actually defined by the following structure scheme. As shown in FIG. 4 and FIG. 5, the diameter D of the second shaft hole 393 of the latch assembly 39 of the operating mechanism 3 is larger than the diameter d of the second shaft section 382 of the pivotal shaft 38 (referring to FIG. 2 and FIG. 5), and the difference Dc of the two diameters is obtained by subtracting the diameter d of the second shaft section 382 from the diameter D of the second shaft hole 393. As shown in FIG. 3 and FIG. 5, the spacing H between the support surface 3831 on the shaft shoulder 383 of the pivotal shaft 38 and the protruding mesa 362 on the lever 36 is larger than the spacing h between the first end face 391 and the second end face 392 of the latch assembly 39 (referring to FIG. 4 and FIG. 5). The spacing difference Hc between the support surface 3831 and the protruding mesa 362 is obtained by subtracting the spacing h from the spacing H. Said diameter difference Dc and the spacing difference Hc together control the directional deflection swing of the latch assembly 39, and the deflection swing direction is the direction X of the contact pressure generated when the latch assembly is meshed with the connecting rod 37 (referring to FIG. 5). In order to gain better effects and be capable of satisfying the demands of the miniature circuit breaker, said spacing difference Hc is preferably 5% to 10% of the diameter d of the second shaft section 382, and a corresponding fit value is evaluated for the diameter difference Dc according to the spacing difference Hc, the diameter d and length L of the second shaft section 382. Or, the diameter difference Dc is preferably 5% to 10% of the length L of the second shaft section 382, and a corresponding fit value is evaluated for the spacing difference Hc according to the diameter difference Dc, the diameter d and length L of the second shaft section 382. The so-called evaluated corresponding fit value is that the parameter value that should be derived by those skilled in the art by using mathematics or other known manners according to the known structural parameters.

It follows that the latch assembly 39 is enabled to deflect and swing along the direction X of the contact pressure produced when the connecting rod 37 is meshed with the latch assembly 39 due to the combined action of the diameter difference Dc and the spacing difference Hc, wherein the deflection swing leads the contact pressure produced when the connecting rod 37 is meshed with the latch assembly 39 keep stable. To be specific, the tripping force of the energy storage spring needs to be transferred to the connecting rod 37 via the lever 36. Both the lever 36 and the connecting rod 37 are connected and installed through the hinge. Due to multiple reasons such as the manual operating force, the impact force of the release, the frictional force of the hinge and the manufacturing error of the hinge connecting structure and the like, the acting force of the connecting rod 37 on the latch assembly 39 is very unstable, and the unstable expression form is that there are big differences on the direction and size of the acting forces between each operation (between intermittent operations, between continuous operations, as well as between intermittent and continuous operations). Since the present invention employs the technical scheme that the latch assembly 39 and the lever 36 are installed on the same pivotal shaft 38, and the latch assembly 39 can deflect swing along the direction X of the contact pressure produced when the connecting rod 37 is meshed with the latch assembly 39, therefore, not only the direction of the acting force of the connecting rod 37 on the latch assembly 39 keeps stable and the size of the frictional force of the mechanism keeps stable, but also the transfer of the tripping force is smooth, thus avoiding the interference of resistance and impact force possibly occurred during the process of transferring the tripping force by the mechanism.

Referring to FIG. 10, the latch assembly 39 is also provided with a second hasp 394, and the connecting rod 37 is provided with a first hasp 371 fitted with the second hasp 394 of the latch assembly 39. The fit described here refers to the contact fit and separated fit between the first hasp 371 and the second hasp 394, and through the fit, the operating mechanism is alternated between the two working states, wherein the first working state is just that the operating mechanism is under a latched state, i.e. under a state that the first hasp 371 and the second hasp 394 are contacted and mutual withhold, wherein under this state, the operating mechanism can finish a closing operation successfully, and can be stabilized at the closing state. Corresponding to the latched state, the connecting rod 37 and the latch assembly 39 are meshed with each other, and the latch assembly 39 controls the drive rod 34 and the lever 36 not to move relatively. The second working state is just that the operating mechanism is under an unlatched state, where the unlatched state is instantaneous. Under this instantaneous state, i.e. under the state that the first hasp 371 and the second hasp 394 are separated and unlatched, the operating mechanism finishes the tripping action automatically under the action of the elastic force of the energy storage spring. Corresponding to the moment of the unlatched state, the connecting rod 37 and the latch assembly 39 are separated mutually, and the latch assembly 39 is separated from the drive rod 34 to lead the drive rod 34 to be capable of sliding along a groove 364 of the lever 36. The other end of the drive rod 34 is connected to the lever 36. This connected specific structure is that the other end of the drive rod 34 is inserted into the groove 364 of the lever 36. When the drive rod 34 is not controlled by the connecting rod 37, the drive rod 34 can slide in the groove 364. The end connected to the lever 36 is also fitted with the control end 370 of the connecting rod 37 and controlled by the control end 370. The so-called fit and control include two situations: one situation is that the control end 370 of the connecting rod 37 is contacted with the other end of the drive rod 34 and defines the other end of the drive rod 34 in the groove 364 of the lever 36 to make the drive rod incapable of sliding; that is, the drive rod 34 is controlled by the connecting rod 37 and cannot move relative to the lever 36. Another situation is that the control end 370 of the connecting rod 37 is separated from the other end of the drive rod 34 and the other end of the drive rod 34 can slide in the groove 364 of the lever 36; that is, the drive rod 34 is not controlled by the connecting rod 37 and can move relative to the lever 36, wherein the movement is just sliding along the groove 364 of the lever 36.

The operating mechanism alternated from the first latched working state to the second unlatched working state is caused by that the release 2 triggers the latch assembly 39 according to the regular working principle and structure thereof, while the operating mechanism alternated from the second unlatched working state to the first latched working state is finished by the return spring 32. One end 321 of the return spring 32 is connected to the lever 36 and the other end 322 is connected to the latch assembly 39; therefore, the elastic force effect of the return spring 32 on the latch assembly 39 exists all the time. During the process of triggering the latch assembly 39 by the release 2, the actuating force of the release 2 drives the latch assembly 39 to rotate forwards after overcoming the elastic force of the return spring 32 acted on the latch assembly 39 and the contact pressure of the connecting rod 37 acted on the latch assembly 39, and actuates the operating mechanism to be alternated from the first latched working state to the second unlatched working state. During the moment of the second unlatched working state, when the release 2 automatically loses the actuating force, the elastic force of the return spring 32 automatically drives the latch assembly 39 to rotate backwards and actuates the operating mechanism to be resumed from the second unlatched working state to the first latched working state. Since the elastic force effect of the return spring 32 exists all the time, and the elastic force of the return spring 32 under the first latched working state is unequal to the elastic force under the second unlatched working state (other words, the elastic force of the return spring 32 is changed), the change of the elastic force of the return spring 32 will also influence the stability of the circuit breaker. In order to solve the problem, the return spring 32 of the present invention employs a scheme of a soft spring having a very small elasticity of the rate of change. The so-called soft spring is just a spring having very soft elasticity characteristic, which refers to a spring applied with an elastic force, the spring have a very small elastic force change corresponding to larger elastic deformation The elasticity characteristic of the spring is determined by such structural parameters as the steel wire diameter, number of turns and the like of the spring. In order to obtain a perfect elasticity characteristic and a physical dimension suitable for the miniature circuit breaker, the preferred parameters of the return spring 32 are preferred as: the steel wire diameter of the spring is equal to or small than 0.3 mm, and the cyclomatic number of the spring is at least 10.

As shown in FIG. 3 and FIG. 6, the lever 36 of the operating mechanism 3 is also provided with a wedge-shaped linking pin 363 which includes a inclined plane 3631 distributed in a wedge-shape along the axial direction of the pivotal shaft 38 (referring to FIG. 6). As shown in FIG. 6, the latch assembly 39 is also provided with a raised surface 395, wherein the raised surface 395 is not contacted with the wedge-shaped inclined plane 3631 when the connecting rod 37 is meshed with the latch assembly 39. When the release 2 triggers the latch assembly 39, the releasing impact force of the release 2 drives the raised surface 394 to be contacted with the wedge-shaped inclined plane 3631 to prevent and eliminate unfavorable axial direction displacements and abnormal deflection swing generated by the latch assembly 39. The actuating force of the release 2 for triggering the latch assembly 39 is a known impact force, wherein the impact force necessarily includes a radial component force parallel with the radial direction of the pivotal shaft 38 and an axial component force parallel with the axial direction of the pivotal shaft 38, wherein the radial component force is useful, while the axial component force will drive the latch assembly 39 to produce unfavorable axial direction displacements and abnormal deflection swing, may possibly make the position of the latch assembly 39 meshed with the connecting rod 37 unstable, make the position of the release 2 contacted with the latch assembly 39 unstable, and makes the stability of the latch assembly 39 decreased and even make the latch assembly contacted with other spare parts in an abnormal way since the deflection swing amplitude exceeds a normal range (i.e. the deflection swing is oversize or in the opposite direction). It needs to be further noted that the present invention has already defined the deflection swing range of the latch assembly 39 through the structures of the pivotal shaft 38, the latch assembly 39 and the lever 36, as well as the structural parameters such as the diameter D of the second shaft hole 393, the diameter d of the second shaft section 382, the diameter difference Dc, the spacing H between the support surface 3831 and the protruding mesa 362, the spacing h between the first end face 391 and the second end face 392, and the spacing difference Hc. Therefore, in the case of not employing the linking pin 363, the circuit breaker can also work; however, possible unfavorable axial direction displacements and abnormal deflection swing of the latch assembly 39 caused by the impact force which is extremely unstable on both size and direction cannot be prevented and eliminated; therefore, the linking pin 363 as shown in FIG. 6 is employed on the lever 36, the gap of the positioning space is gradually reduced through the impact effect of the wedge-shaped structure, the deflection swing of the latch assembly can be eliminated, and the instability problem caused by the impact force can be effectively overcome.

Further, it is found by the proposer through tests that the impact of the breaking air flow on the arc extinguish chamber focuses on the front end of the arc extinguish chamber, while the intensity at the front end of the existing arc extinguish chamber is usually weakest due to structure limitation; therefore, the failure of the intensity at the front end of the arc extinguish chamber is another important cause that causes the poor stability of the circuit breaker. FIGS. 8-9 are schematic perspective views of the arc extinguish chamber 4 according to embodiments of the present invention. FIG. 8 shows structures of the insulated gate boards 43, arc extinguish gate sheets 44 and insulated baffle ribs 42 forming the arc extinguish chamber 4 as well as an assembly relationship therebewteen. FIG. 9 is a schematic perspective view of spare parts of the insulated baffle ribs 42 of the arc extinguish chamber 4 as shown in FIG. 8, showing the width t of the gear top of the gears 421 of the insulated baffle ribs 42, the width T of the gear root and gear root spacing M. The present invention skillfully overcomes the problem of weaker intensity at the front end of the existing arc extinguish chamber by additionally arranging the insulated baffle ribs 42. Moreover, a structure scheme of the gears 421 that the width t of the gear top is smaller than the width T of the gear root is also combined, so that the impact of the breaking air flow on the arc extinguish chamber can be eased, the arcs can be elongated and cooled again, and the arc voltage value of the arc extinguish chamber can be improved again, thus further enhancing the working stability of the circuit breaker. As specifically shown in the figure, the arc extinguish chamber 4 includes two separately and relatively disposed insulated gate boards 43 and a plurality of arc extinguish gate sheets 44 respectively clamped and fixed between the two separate insulated gate boards 43 by equal gate sheet spacing m, so as the two arc extinguish gate sheets are connected into a whole body. The clamping and fixing structure as shown in FIG. 7 herein may employ a known technology. The arc extinguish chamber 4 further includes two insulated baffle ribs 42. Each insulated baffle rib 42 is a rack-shaped structure as shown in FIG. 7 and FIG. 8 and formed by the insulated board body 422 and the gears 421 formed above the insulated board body 422. The insulated board bodies 422 of the two insulated baffle ribs 42 are respectively overlapped and fixed at the front ends of the two separate insulated gate boards 43. The width t of the gear top of each gear 421 is smaller than the width T of the gear root of each gear, said width T of the gear root is equal to the gate sheet spacing m between the two arc extinguish gate sheets 44. The root portion of each gear 421 is correspondingly embedded and fixed in each gate sheet spacing m of the arc extinguish gate sheet 44, and each arc extinguish gate sheet 44 is embedded and fixed in the gear root spacing M of each gear 421. The gear root spacing M between two adjacent gear roots is equal to the thickness S of the arc extinguish gate sheet 44. It follows that since the two insulated baffle ribs 42 are not only respectively overlapped and fixed at the front ends of the two insulated gate boards 43 through the insulated board body 422, but also are embedded and fixed with each arc extinguish gate sheets 44 at the same time. The insulated baffle ribs 42 are connected through an entire plane, thus ensuring the structure integrity of the insulation baffle ribs during the breaking process; therefore, the intensify at the front end of the arc extinguish chamber 4 is enhanced apparently. In order to gain better effects and better satisfy the size demand of the miniature circuit breaker, the proportion of said width t of the gear top of the gear 421 to the width T of the gear root is preferred as: the width t of the gear top does not exceed 50% of the width T of the gear root.

The existing technical solutions only satisfy the function demand of the latch assembly for locking the mechanism in the operating mechanism, but are far from controlling the tripping force. The latch assembly will produce different static frictional forces while being installed, operating and restored. According to the above technical schemes of the present invention, the static frictional force of the locating surface caused by that the driving force and the contact pressure produced by the meshing between the latch assembly and the connecting rod of the operating mechanism are not in the same plane is eliminated through the free deflection swing of the latch assembly, and the contact manner between the latch assembly and the rotating shaft thereof is controlled through the deflection and swing so as to control the static frictional force. When the function demand of the latch assembly is satisfied preferably, a certain angle free deflection swing of the latch assembly produced under the action of the contact pressure produced when the latch assembly is meshed with the connecting rod on the lever may be realized, and the static frictional force between the latch assembly and the locating surface can be eliminated, so that the static frictional force is only produced by the rotating shaft and the return spring. Due to the deflection swing of the latch assembly, the static frictional force produced by the latch assembly around the shaft is changed from surface contact into point of contact or line contact, and the fluctuation of the static frictional force is also controlled apparently. The fluctuations of the tripping force born on the latch assembly 39 in intermittent operation and continuous operation are both stabilized within a preset allowable range of simulating calculation values, and the tripping force of the latch assembly fluctuated in a controllable range is realized, the stability of the circuit breaker is improved significantly, and the arc extinguish ability is enhanced apparently. Furthermore, the noticeable effects of the foregoing technical schemes of the present invention not only lies in the improvement of the stability, but also lies in improvement of other performances caused by the improvement of the stability, such as: decreasing of the operating force, decreasing of the tripping force, enhancing of the breaking ability, miniaturization improvement of related parts due to the decreasing of the operating force and the tripping force, and the like.

The invention claimed is:

1. A high-stability miniature circuit breaker, comprising a release, an operating mechanism, an arc extinguish chamber and a contact assembly, wherein said operating mechanism comprises a handle installed on a handle shaft of a shell in a pivoting way, a drive rod, a lever, a connecting rod installed on a pivotal shaft of the lever in a pivoting way, a latch assembly, a return spring; one end of said drive rod is connected to a hinge of the handle, the other end of the drive rod is connected to the lever, and the end of the drive rod connected to the lever is also fitted with a control end of the connecting rod and controlled by the control end; and said contact assembly is connected to the lever through a contact support, wherein:

said operating mechanism further comprises a pivotal shaft fixed on the shell, which comprises a first shaft section, a second shaft section and a shaft shoulder; a diameter of said second shaft section is larger than that of the first shaft section, and a thrust surface is formed on the second shaft section at a transition portion of the two shaft sections; a diameter of said shaft shoulder is larger than that of the second shaft section, and a support surface is formed on the shaft shoulder at the transition portion of the second shaft section and the shaft shoulder;

said lever is installed on the first shaft section of the pivotal shaft through a first shaft hole in a pivoting way, and is used for limiting the axial position of a protruding mesa relative to said pivotal shaft through contact fit between the protruding mesa disposed on the lever and the thrust surface on said pivotal shaft;

said latch assembly is installed on the second shaft section of the pivotal shaft through a second shaft hole in a pivoting way; one end of said second shaft hole comprises a first end face fitted with a support surface of said pivotal shaft; the other end of said second shaft hole comprises a second end face fitted with the protruding mesa of the lever; and the latch assembly is also provided with a second hasp;

a first hasp fitted with the second hasp of the latch assembly is disposed on said connecting rod, said connecting rod is meshed with the latch assembly when the first hasp and the second hasp are contacted and latched with each other, and the latch assembly controls the drive rod and the lever not to move relatively; said connecting rod is separated from the latch assembly when the first hasp and the second hasp are separated and unlatched, and the latch assembly is separated from the drive rod to lead the drive rod to be capable of sliding along a groove of the lever.

2. The high-stability miniature circuit breaker according to claim 1, wherein:

a diameter D of the second shaft hole of said latch assembly is larger than the diameter d of the second shaft section of said pivotal shaft, and a difference Dc of the two diameters is obtained by subtracting the diameter d from the diameter D;

a spacing H between the support surface on the shaft shoulder of said pivotal shaft and the protruding mesa on the lever is larger than a spacing h between the first end face and the second end face of said latch assembly, and a spacing difference Hc is obtained by subtracting the spacing h from the spacing H;

said diameter difference Dc and said spacing difference Hc together control a directional deflection swing of the latch assembly, and a direction of said deflection swing is a direction X of a contact pressure generated when the latch assembly is contacted with the connecting rod.

3. The high-stability miniature circuit breaker according to claim 2, wherein: said spacing difference Hc is 5% to 10% of the diameter d of the second shaft section of said pivotal shaft, and a corresponding fit value is evaluated for said diameter difference Dc according to the spacing difference Hc, the diameter d and a length L of the second shaft section of said pivotal shaft; or, the diameter difference Dc is 5% to 10% of the length L of the second shaft section of said pivotal shaft, and a corresponding fit value is evaluated for said spacing difference He according to the diameter difference Dc, the diameter d and a length L of the second shaft section of said pivotal shaft.

4. The high-stability miniature circuit breaker according to claim 1, wherein:

said lever is also provided with a wedge-shaped linking pin which comprises an inclined plane distributed in a wedge-shape along an axial direction of said pivotal shaft;

said latch assembly is also provided with a raised surface; said raised surface is not contacted with the wedge-shaped inclined plane when the connecting rod is meshed with the latch assembly; when a release triggers the latch assembly, a releasing impact force of the release drives said raised surface to be contacted with the wedge-shaped inclined plane to prevent and eliminate unfavorable and abnormal deflection swing generated by the latch assembly.

5. The high-stability miniature circuit breaker according to claim 1, wherein:

said arc extinguish chamber comprises two separately and relatively disposed insulated gate boards and a plurality of arc extinguish gate sheets respectively clamped and fixed between the two separate insulated gate boards by equal gate sheet spacing m;

said arc extinguish chamber further comprises two insulated baffle ribs; each insulated baffle rib is a rack-shaped structure formed by an insulated board body and gears above the insulated board body; the insulated board bodies of the two insulated baffle ribs are respectively overlapped and fixed at front ends of the two separate insulated gate boards; a width t of a gear top of each gear is smaller than a width T of a gear root of each gear; said width T of the gear root is equal to a gate sheet spacing m between the two adjacent arc extinguish gate sheets; a root portion of each gear is correspondingly embedded and fixed in each gate sheet spacing m of the arc extinguish gate sheet, and each arc extinguish gate sheet is embedded and fixed in a gear root spacing M of each gear; and the gear root spacing M between two adjacent gear roots is equal to a thickness S of the arc extinguish gate sheet.

6. The high-stability miniature circuit breaker according to claim 5, wherein the width t of the gear top of the gear on said insulated board body does not exceed 50% of the width T of the gear root.

7. The high-stability miniature circuit breaker according to claim 1, wherein: said return spring is a soft spring having a very small elasticity change rate; one end of the return spring is connected to the lever, and the other end of the return spring is connected to the latch assembly; a wire diameter of the return spring is equal to or smaller than 0.3 mm, and a cyclomatic number of the return spring is at least 10.

8. The high-stability miniature circuit breaker according to claim 1, wherein: a free end of the first shaft section of said pivotal shaft comprises a first end tip;

the shaft shoulder of said pivotal shaft further comprises a second end tip relative to a counter direction of the first end tip; said first end tip and the second end tip are respectively fixedly connected to the shell; or said pivotal shaft comprises the first end tip fixedly connected to the shell; or said pivotal shaft comprises the second end tip fixedly connected to the shell.

9. The high-stability miniature circuit breaker according to claim 1, wherein: the axial position of the protruding mesa of the lever relative to the pivotal shaft is driven by a force of the shell acting on the lever so that a contact fit between the protruding mesa and said thrust surface on the pivotal shaft is realized; or, driven by a force of a transition piece acting on the lever so that the contact fit between the protruding mesa and said thrust surface on the pivotal shaft is realized.

10. The high-stability miniature circuit breaker according to claim 1, wherein: shaft centers of the first shaft section, the second shaft section and the shaft shoulder of said pivotal shaft are all concentric; or, one of the shaft centers of the first shaft section, the second shaft section and the shaft shoulder is not concentric with the other two shaft centers; or, the three shaft centers of the first shaft section, the second shaft section and the shaft shoulder are not concentric with each other.

* * * * *